US005807434A

United States Patent [19]

Innes

[11] Patent Number: 5,807,434

[45] Date of Patent: Sep. 15, 1998

[54] APPARATUS FOR TWO-SIDED COATING OF ELONGATED STRIP ARTICLES

[75] Inventor: Robert A. Innes, Kingston, Canada

[73] Assignee: Alcan International Limited, Montreal, Canada

[21] Appl. No.: 747,905

[22] Filed: Nov. 2, 1996

Related U.S. Application Data

[63] Continuation of Ser. No. 68,990, May 27, 1993, abandoned.

[51] Int. Cl.[6] ..... B05C 5/02

[52] U.S. Cl. ..... 118/226; 118/216; 118/220; 118/235; 118/255; 118/122

[58] Field of Search ..... 118/121, 122, 118/216, 220, 226, 235, 255, 316

[56] References Cited

U.S. PATENT DOCUMENTS

| | | | |
|---|---|---|---|
| Re. 31,695 | 10/1984 | Zink | 427/211 |
| 2,784,697 | 3/1957 | Uhleen | 118/411 |
| 3,285,225 | 11/1966 | Recor . | |
| 3,418,970 | 12/1968 | Phelps et al. . | |
| 3,698,355 | 10/1972 | Heijnis et al. | 118/411 |
| 3,899,999 | 8/1975 | Christ et al. . | |
| 3,930,464 | 1/1976 | Wallsten | 118/122 |
| 4,233,930 | 11/1980 | Wohlfeil | 118/122 |
| 4,327,130 | 4/1982 | Pipkin | 427/209 |
| 4,345,543 | 8/1982 | Pipkin | 118/106 |
| 4,387,124 | 6/1983 | Pipkin | 427/356 |
| 4,391,219 | 7/1983 | Schaming | 118/630 |
| 4,411,218 | 10/1983 | Wollam et al. | 118/411 |
| 4,445,458 | 5/1984 | O'Brien | 118/401 |
| 4,558,658 | 12/1985 | Sommer et al. | 118/411 |
| 4,675,230 | 6/1987 | Innes | 427/280 |
| 4,790,257 | 12/1988 | Schermutzki | 118/227 |
| 4,889,073 | 12/1989 | Meinander | 427/356 |
| 5,147,462 | 9/1992 | Wollam | 118/679 |
| 5,407,702 | 4/1995 | Smith et al. . | |

FOREIGN PATENT DOCUMENTS

| | | |
|---|---|---|
| 477168 | 11/1974 | Australia . |
| 1054873 | 5/1979 | Canada . |
| 0453427 | 10/1991 | European Pat. Off. . |
| 1460923 | 12/1966 | France . |
| 2321952 | 3/1977 | France . |
| 3444461 | 6/1986 | Germany . |
| 4930697 | 8/1974 | Japan . |
| 60-250936 | 12/1985 | Japan . |

OTHER PUBLICATIONS

International Search Report dated Sep. 23, 1994 in International Application No. PCT/CA94/00291.

*Primary Examiner*—Long V. Le
*Attorney, Agent, or Firm*—Cooper & Dunham LLP

[57] ABSTRACT

Apparatus for coating both opposed major surfaces of an elongated strip article with paint, lacquer, lubricant or the like, using two facing coating heads respectively having lands, between which the strip is advanced. Liquid coating material, delivered to the strip surfaces through elongated slits formed in the coating heads immediately upstream of the lands, is dragged out on the moving surfaces as layers metered between the lands and the strip. A load is continuously exerted (by devices such as air cylinders) on at least one of the lands during the coating operation for urging the lands against the applied coating layers.

13 Claims, 7 Drawing Sheets

APPARATUS FOR TWO-SIDED COATING OF ELONGATED STRIP ARTICLES

This is a Continuation of application Ser. No. 068,990, filed May 27, 1993, now abandoned.

BACKGROUND OF THE INVENTION

This invention relates to apparatus and methods for simultaneously applying liquid coating material to both sides of an elongated flexible strip article.

Among illustrative uses of the present invention are the application of two-sided lacquer coatings to aluminum can end stock, the application of lubricant coatings to both sides of aluminum sheet which is to be subsequently formed into automobile body panels, and the application of paint or the like to sheet metal strip from which (by subsequent forming and cutting operations) end products such as siding panels are made.

U.S. Pat. No. 4,675,230, the disclosure of which is incorporated herein by this reference, describes apparatus and procedure for applying a paint or like coating to an elongated strip article using a coating head having a slit to which coating material is supplied under pressure, and a support such as a roll around which the strip is advanced past the head for receiving from the slit a layer of paint metered between the head and the strip, wherein a load is continuously exerted on the head during operation for urging the head against the applied paint layer on the strip so as to maintain a uniform metering gap between the head and the coated strip surface. The load may be exerted by devices such as air cylinders acting on the head and capable of adjustment to vary the magnitude of the load for different coating operations. In this way, a coating of superior uniformity can readily be applied to a surface of an article such as sheet metal strip, notwithstanding that the strip characteristically exhibits some variation in thickness along its length; the maintenance of a load on the coating head facilitates accuracy and ease of setup, and also enables the head to conform positionally to variations in strip thickness (for maintaining a constant metering orifice aperture) without resort to mechanical elements engaging the strip, thereby avoiding the problems of surface marks or other irregularities (discussed in the aforementioned patent) that tend to result from use of such elements.

U.S. Pat. No. 5,147,462 (the disclosure of which is also incorporated herein by this reference) describes apparatus for automatic film thickness control in coating procedures and apparatus of the same general type.

The method and apparatus of the aforementioned patent are disclosed as arranged for applying a coating to one side only of a strip article. Frequently, however, it is necessary or at least beneficial to apply a coating to both surfaces of a sheet metal strip or other strip article before the strip is formed and cut into end products. While devices for two-sided coating of strip articles are known, as exemplified by U.S. Pat. Nos. 2,784,697, 3,930,464, 4,233,930, 4,327,130, 4,345,543 (see also 4,387,124), 4,558,658, and 4,889,073, and U.S. reissue Pat. No. 31,695, some of these devices are not adapted for coating such articles as metal strip of siding-panel gauge; and it would in any event be desirable to provide means and methods for two-sided coating affording the special combination of structural simplicity, operating convenience, and uniformity of coating application achieved (with respect to one-sided coating) by the method and apparatus of the aforementioned U.S. Pat. No. 4,675,230.

SUMMARY OF THE INVENTION

The present invention, in a first aspect, broadly contemplates the provision of apparatus for continuous two-sided coating of an elongated strip article, including means for defining a path of continuous longitudinal advance of an elongated strip article having opposed major surfaces to be coated, the path including a rectilinear portion in which the opposed surfaces of the strip article are substantially planar; two rigid coating heads each defining an elongated open-sided slit and each including a land portion having an extended surface immediately adjacent the open side of the slit, for respectively depositing layers of liquid coating material on the opposed major surfaces of a strip article advancing in the path; and means for supplying liquid coating material under pressure to the slit of each head.

The apparatus of the invention also includes means for supporting the two heads in facing relation to each other on opposite sides of the rectilinear portion of the strip article path while permitting individual translational movement of at least the land portion of at least one of the two heads relative to the supporting means in a direction perpendicular to the major surfaces of a strip article advancing in the path. This supporting means positions the heads such that their slits respectively open toward the opposed major surfaces of an advancing strip article in the rectilinear path portion with their long dimensions extending transversely of the path; such that the extended surfaces of the two heads are disposed, substantially in register with each other, beyond the slits in the direction of strip article advance, with these extended surfaces respectively facing the opposed major surfaces of an advancing strip article and converging toward each other and toward the path in the direction of article advance; and such that during operation with the article advancing past the slits and liquid coating material supplied to both slits as aforesaid, the article major surfaces respectively drag layers of coating material from the slits, the layers being thereby deposited on the article major surfaces.

Additionally, in combination with the foregoing features, the apparatus of the invention includes means for continuously exerting a load on at least the land portion of the aforementioned one head during operation as aforesaid such that the layers of coating material deposited on the strip major surfaces are pressed between the extended surfaces of the heads to maintain the deposited coating layers at predetermined constant thicknesses while the coating layers alone hold the heads entirely away from contact with the article major surfaces.

In currently preferred embodiments of the invention, at least the aforesaid one head comprises a land portion as defined above and a portion that is stationary during operation, the land portion being movable relative to the stationary portion and cooperating therewith to define the slit. The load-exerting means, in these embodiments, acts between the supporting means and the land portion of the one head. In other embodiments, the aforesaid one head is formed integrally and the load-exerting means acts between the supporting means and the entire head, which is capable of moving as a unit relative to the supporting means during operation.

Also, for particular applications, it is currently preferred that the other of the heads (including its land portion) be held entirely stationary during the coating operation, so that the load-exerting means acts only on the aforesaid one head (or, at least, its land portion). In other instances, both heads (or their land portions) are movable relative to the supporting means during operation, and are both acted on by the load-exerting means. Advantageously, in the latter case, the load-exerting means for the two heads are adjustable to individually vary the loads exerted on the two heads.

The load-exerting means for each head conveniently or preferably comprises at least one air cylinder acting thereon. More preferably, especially when the land portion of a head is movable relative to a stationary portion of the head, the load-exerting means therefor comprises a plurality of air cylinders acting at points spaced along the length of the land portion, and the land portion is made sufficiently flexible to conform to variations of strip thickness across the width of the strip, for enhanced coating uniformity.

In addition, the supporting means may include means for individually varying the angular orientations of the respective extended surfaces of the heads in the direction of advance of the strip article; and the extended surface of one of the heads may be longer than that of the other in the direction of advance of the strip article in the path.

In a second aspect, the invention contemplates the provision of a method of continuously and simultaneously applying layers of liquid coating material to both opposed major surfaces of an elongated flexible strip article, comprising the steps of continuously longitudinally advancing an elongated flexible strip article having opposed major surfaces to be coated along a path having a rectilinear portion in which the aforesaid opposed surfaces are substantially planar; supplying liquid coating material under pressure to two elongated, open-sided slits respectively defined in two rigid coating heads each including a land portion having an extended surface immediately adjacent the open side of the slit therein defined, while supporting the two heads in facing relation to each other on opposite sides of the aforesaid rectilinear portion of the path and while permitting individual translational movement of at least the land portion of at least one of the heads relative to the supporting means in a direction perpendicular to the strip major surfaces, the heads being positioned such that their slits respectively open toward the opposed major surfaces of the strip article advancing in the aforesaid path portion with their long dimensions extending transversely of the path; such that the extended surfaces of the two heads are disposed, substantially in register with each other, beyond the slits in the direction of strip article advance, with the aforesaid extended surfaces facing respectively the opposed major surfaces of the advancing strip article and converging toward each other and toward the path in the direction of strip article advance; and such that the article major surfaces respectively drag layers of coating material from the slits, the layers being thereby deposited on the article major surfaces; and continuously exerting a load on at least the land portion of at least one of the heads such that the layers of coating material deposited on the strip surfaces are pressed between the extended surfaces of the heads to maintain those coating layers at predetermined constant thicknesses while the coating layers alone hold the heads entirely away from contact with the article major surfaces.

In summary, the present invention represents an improvement on that described in U.S. Pat. No. 4,675,230, enabling simultaneous application of coatings to both sides of a moving strip or sheet. The arrangement comprises two coating heads (of the general type described in the last-mentioned patent) mounted face-to-face with the strip passing between them.

Satisfactory operation of this arrangement requires that the clearances between the metering lands (extended surfaces) of both coating heads and the strip converge in the direction of sheet travel. Such convergence generates a hydrodynamic pressure, between the extended surface of each head and the strip, that will increase as the strip gets closer to the head surface. Thus, provided that the angles of convergence are chosen correctly, there will be an equilibrium position for the strip where the pressure forces on both sides will be equal.

The position of equilibrium and hence the coating film thickness distribution on the two sides of the strip can be controlled in two ways, viz. by varying either the angle of convergence or the lengths (in the direction of strip advance) of the extended surfaces of the heads. Within limits, increasing the angle of convergence will increase the hydrodynamic pressures generated. Therefore, increasing the angle for one of the two heads will cause the position of strip equilibrium to shift away from that head and the coating film thickness on that side of the strip will increase. Similarly, increasing the length of the extended surface of one of the heads will cause the film thickness to increase on that side of the strip.

Further features and advantages of the invention will be apparent from the detailed description hereinbelow set forth, together with the accompanying drawings.

DETAILED DESCRIPTION

Referring first to FIGS. 1–6, the invention will be initially described, for purposes of illustration, as embodied in procedures and apparatus for coating sheet metal strip to establish a uniform, single-color paint layer on each of the two opposed major surfaces of the strip before the strip is formed and cut to produce siding panels. Such strip is typically an elongated, flat sheet metal article (having a length corresponding to the combined lengths of a substantial number of panels, and a width corresponding to the width of one or more panels), of a gauge suitable for siding panels, and is usually coiled for ease of handling.

Figure 1:
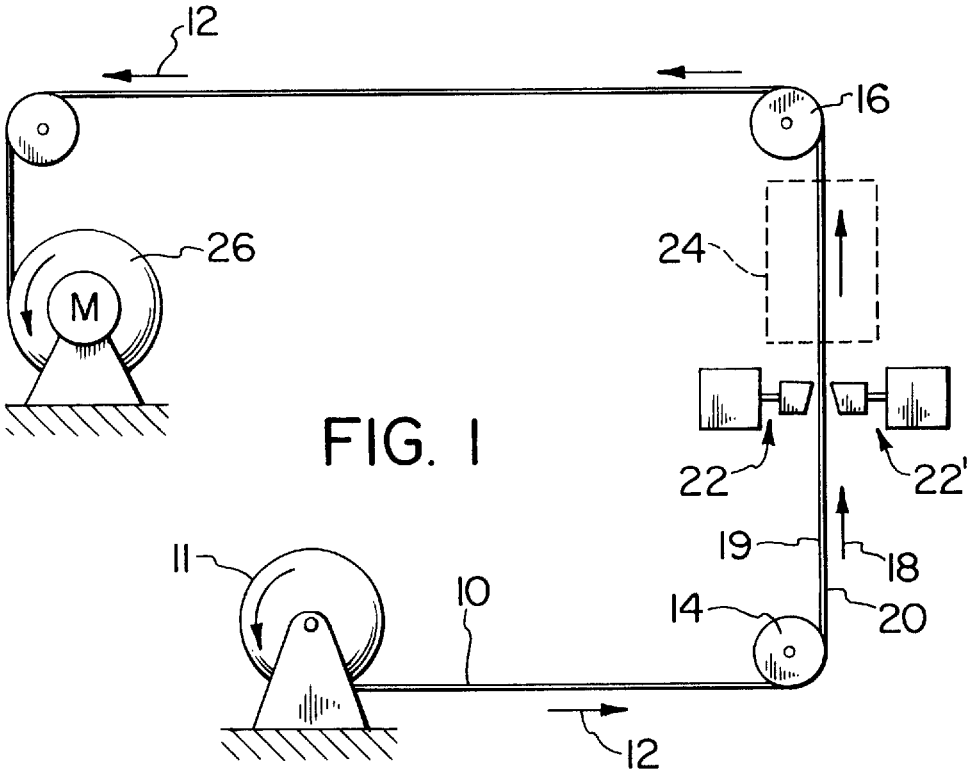
FIG. 1 is a highly simplified schematic view of a strip-coating line incorporating an illustrative embodiment of the apparatus of the invention.

In the coating line schematically shown in FIG. 1, metal strip 10 to be coated is continuously advanced, in a direction longitudinally parallel to its long dimension, from a coil 11 along a path (represented by arrows 12) extending successively around spaced guide rollers 14, 16 rotatably supported (by structure not shown) in axially fixed positions. The rollers 14, 16 cooperatively define a rectilinear portion 18 of the path 12, in which portion the major surfaces of the advancing strip are substantially planar. At a locality in this path portion 18, paint is applied to both major surfaces 19, 20 of the strip from two coating devices 22, 22' (disposed in register with each other and respectively facing the two major surfaces of the strip article) to establish on each of the strip surfaces a continuous layer or coating of the paint. It will be understood that either or both of the strip major surfaces may bear a previously applied undercoat or primer coat of paint. Beyond the coating devices but ahead of roll 16 in the path of strip advance, the strip is passed through an oven 24 to cure the coating. After passing roll 16, the coated strip is coiled again, e.g. on a driven rewind reel 26 which constitutes the means for advancing the strip through the coating line. It will be understood that the arrangement of rolls 14 and 16 and reel 26, with the associated oven 24, is merely exemplary of means for continuously advancing the strip longitudinally along a path having a rectilinear portion 18 at which the coating devices 22, 22' are located.

Figure 3:
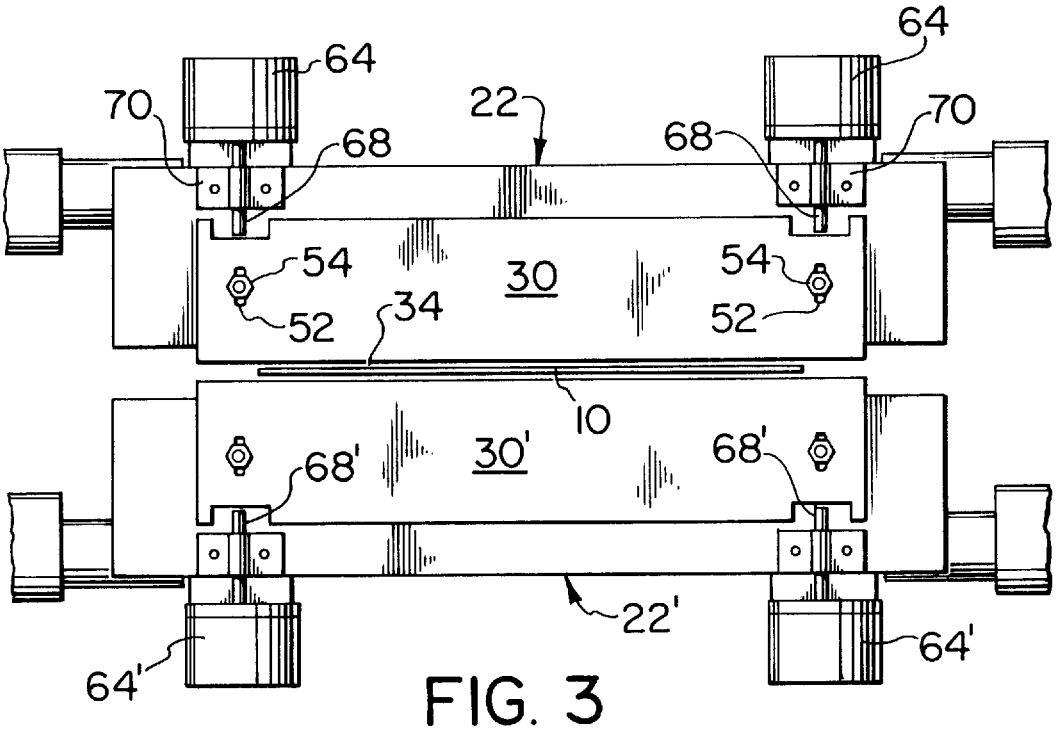
FIG. 3 is a plan view of the apparatus of FIG. 2.

The coating device 22 includes a rigid coating head comprising a metal block 30 having a flat surface 32 facing and spaced from the surface 19 of the advancing strip article to define therewith a gap 34. As best seen in FIG. 3, the head 30 extends over the entire width of the strip at a locality, in the portion 18 of the path of strip advance, at which the strip is also passing the coating device 22'.

Formed in the head 30 is an elongated slit 36 which opens outwardly through the surface 32 of the head. This slit is axially rectilinear and of uniform cross section throughout, with its ends closed by dams or shutters (not shown) inserted in and positionally adjustable along the slit to define the ends of the effective (paint-discharging) aperture of the slit. It is oriented with its long dimension perpendicular to the direction of advance of the strip 10.

Figure 2:
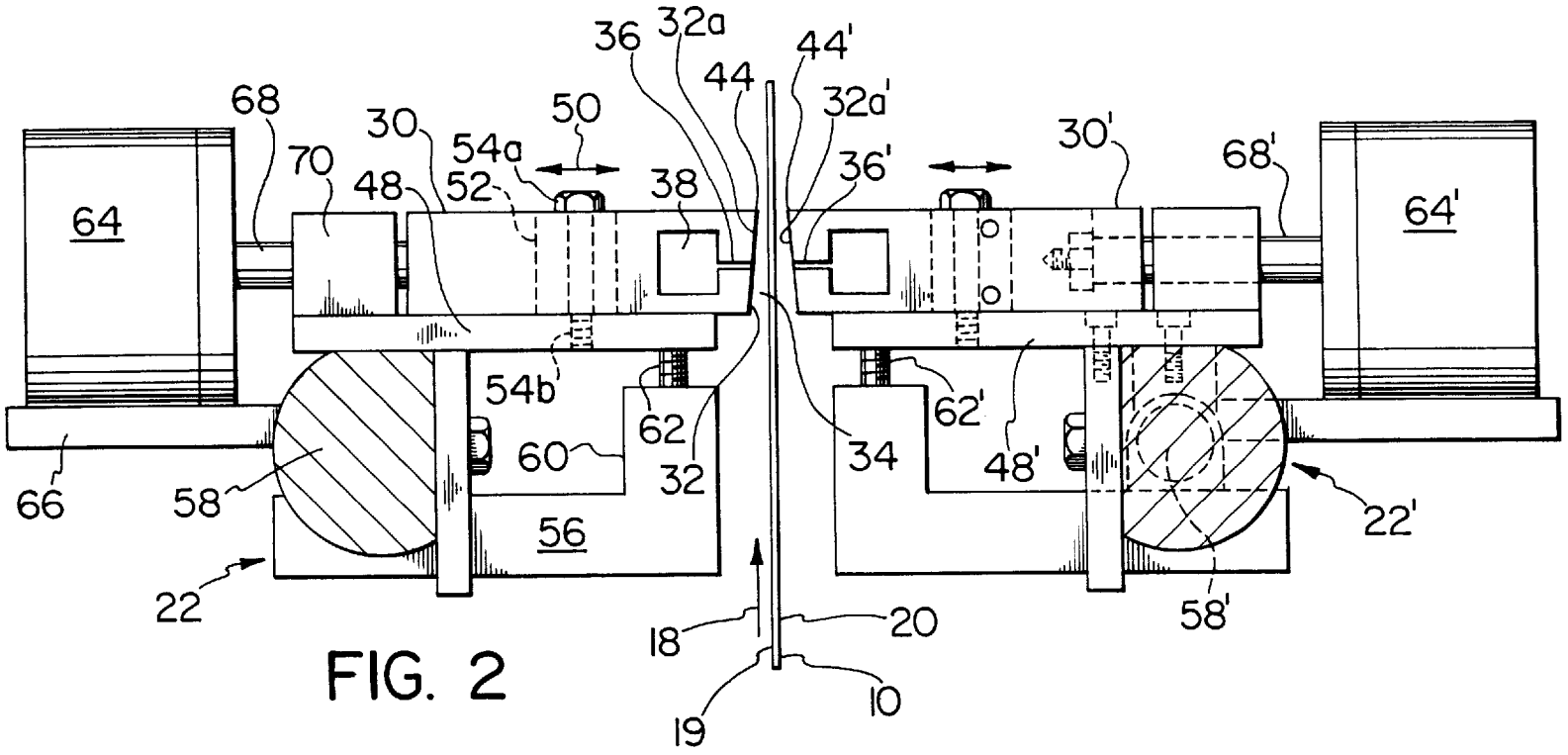
FIG. 2 is an enlarged elevational view of the embodiment of the invention incorporated in the line of FIG. 1.
Figure 4:
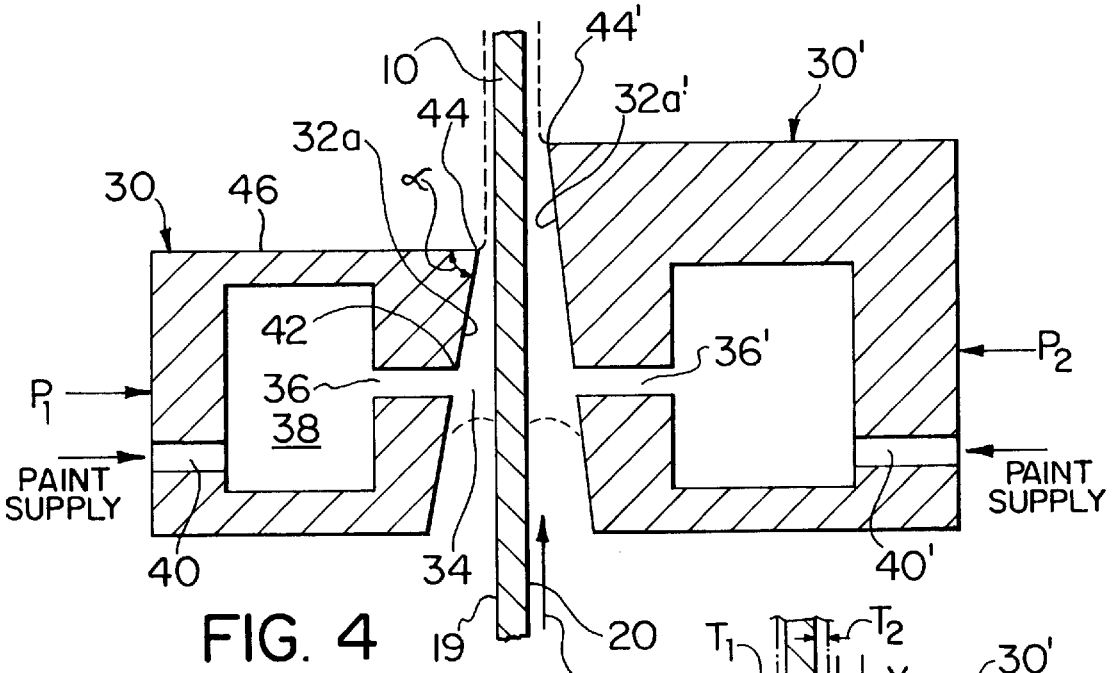
FIG. 4 is a further enlarged and simplified elevational sectional view of the coating heads of an apparatus embodiment of the invention, of the general type shown in FIG. 2.
Figure 6:
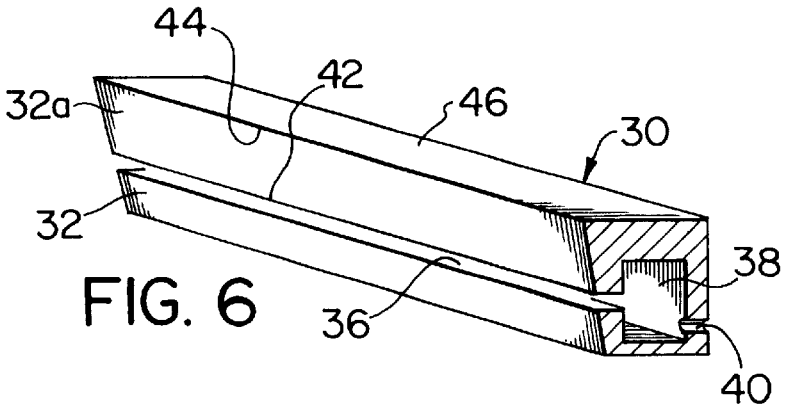
FIG. 6 is a fragmentary perspective view of one of the heads shown in FIG. 4.

Extending within the head 30, in axially parallel relation to the slit, is an elongated enclosed manifold chamber 38 for containing liquid coating material (paint) under pressure. The slit 36 opens inwardly through one wall of this chamber along the entire length thereof, so that paint (supplied to the manifold chamber through one or more feed passages 40 formed in the head 30, as shown in FIGS. 4 and 6) flows from the manifold chamber through the slit. In operation, paint is continuously delivered from a container (not shown) under pressure (by any suitable, e.g. conventional, means, not shown, typically employing hydrostatic pressure or a pump to provide the required pressurized feed) through at least one of the passages 40 to the manifold chamber at a rate sufficient to keep the manifold chamber entirely filled and to force the paint therefrom under pressure through the slit 36, so that the slit as well is continuously entirely filled with paint under pressure. For uniform monochromatic coating, a single color of paint is supplied to the manifold; alternatively, however, the head 30 may be constructed as shown in FIGS. 1 and 2 of the aforementioned U.S. Pat. No. 4,675,230 and (as described in that patent) arranged to produce a striated or variegated coating of two or more colors. In a broad sense, the apparatus and method of the invention are equally applicable to the production of single-color and multi-color (patterned) coatings.

By way of example, to apply a single-color paint coating the width of slit 36 in the direction of strip advance (viz. the width of the slit opening through surface 32) may be 0.04 inch, and the length of the slit (from surface 32 to manifold 38) may be ¼ inch.

As will be understood from the foregoing description, the slit 36 has an open long side (viz. the opening of the slit through surface 32) which extends, transversely of the path of strip advance, from end to end of the slit. The location and length of the effective aperture of this open slit side (established, for example, by the aforementioned dams or shutters) determine the position and width, on the advancing strip, of the coating to be applied. That is to say, the effective aperture of the open long side of the slit, through which paint is delivered to the facing strip surface, has a length less than or equal to the strip width, and is disposed for register with that portion of the width of the strip surface 19 which is to be coated.

The described arrangement of slit and strip results in deposit of paint from the slit onto the strip surface 19 over the full width of the portion of the surface 19 that coincides with the effective aperture of the slit, i.e. when the slit is filled with liquid paint delivered through manifold chamber 38. The deposited paint is carried out of the slit as a coating on the advancing strip surface 19, past the outlet edge 42 of the open side of the slit and through the gap between the surface 32 and the strip surface 19 beyond the slit. The downstream edge 44 of surface 32, shown as a sharp discontinuity between the surface 32 and the upper end 46 of the head 30, extends across the width of the deposited paint coating on the strip surface 19 and, together with the surface 19, defines a metering orifice that determines the thickness of paint coating carried on the strip away from the head; as will be understood, the spacing between the surface 19 and edge 44 should be such as to constitute a gap providing a desired wet thickness of paint coating on the surface 19, this wet thickness being less than the aperture of the gap. The coated strip surface emerges from beneath the head past edge 44. Preferably, the plane of the end 46 converges with the plane of surface 32 at an angle $\alpha$ (at edge 44, FIG. 4) of not more than about 90°, for assured avoidance of pick-up of paint from the emerging strip onto the end 46.

The slit 36 and edge 44 of the head 30 are spaced apart, in the direction of strip advance, so that an extended portion 32*a* of the flat surface 32 lies between them. Provision of this extended surface (portion 32*a*), facing the strip surface 19 downstream of slit 36, is important for the coating operation of the invention, as hereinafter further explained. The extended surface 32*a* is oriented to progressively approach the facing strip surface 19 in the direction of strip advance, i.e., such that surfaces 32*a* and 19 converge in the latter direction, with the distance between strip and head reaching a minimum at edge 44.

The device 22 further includes a deck 48 having a flat upper surface on which the head 30 rests, the head being thus supported for translational (sliding) movement relative to the deck in a generally horizontal direction (arrow 50) perpendicular to the long dimension of the slit 36, i.e. toward and away from the advancing strip. As best seen in FIGS. 2 and 3, a pair of vertically opening slots 52, elongated horizontally in the direction of arrow 50, are formed in the body of the head 30 rearwardly of the manifold 38 at locations spaced along the length of the head; a pair of bolts 54 respectively extend through these slots and are threaded in the deck. The bolt heads 54*a* overlie the top surface of the coating head 30 for preventing vertical movement of the head 30 relative to the deck, while interference between the bolt shanks 54*b* and the side walls of the slots 52 prevents lateral movement of the head 30 relative to the deck, but the elongation of the slots permits the head 30 to move in the direction of arrow 50 through the full range of operative head positions.

The deck 48 is mounted on a fixed frame 56 for pivotal movement about a horizontal axis 58, so as to enable the head 30, with the deck, to be swung upwardly (e.g. by suitable pneumatic means, not shown) from the position illustrated in FIG. 2 to a position removed from the path of strip advance. An arm 60, fixedly secured to the frame 56 and underlying the deck 48, carries a screw 62 that projects upwardly from the arm and bears against the lower surface of the deck 48, to enable adjustment of the angular orientation of the head 30 in its operative position.

The frame 56 is fixed in position relative to the strip path portion 18 defined by rollers 14 and 16, both the frame and the rollers being (for example) fixedly mounted in a common support structure (not shown). Thus, the axis 58 is fixed in position relative to the axes of the rollers 14 and 16; and when the deck 48 is in the operative position shown in FIG. 2, with the screw 62 set to provide a desired angular orientation, the rectilinear path portion 18 is at a fixed distance from the deck 48.

In addition, the coating device 22 includes means acting between the deck 48 and the head 30 for continuously exerting a load on the head to urge the head toward the facing major surface 19 of the strip 10. This load-exerting means, in the illustrated embodiment of the apparatus, comprises a pair of air cylinders 64 fixedly secured to the deck 48 rearwardly of the head 30. As shown, the cylinders 64 are secured to rearwardly projecting ledge portions 66 of the deck, respectively adjacent opposite extremities of the long dimension of the slit 36. Each air cylinder includes a piston having a shaft 68 which extends forwardly from the cylinder, and through a guide block 70 mounted on the deck 48, to bear against a rear surface of the head 30.

Thus, actuation of the air cylinders (which may be of a generally conventional character and accordingly need not be described in detail) causes the piston shafts 68 to push the head 30 toward the surface 19 of strip 10 advancing in path portion 18. As best seen in FIG. 3, the localities of engagement of the two air cylinder piston shafts 68 with the head 30 are spaced equidistantly from the extremities of the slit 36; in the case of a very long head, a greater number of air cylinders may be employed, and in such case, these additional cylinders may be arranged to act on the head at locations spaced along the slot long dimension.

The coating device 22' in the embodiment of the invention illustrated in FIGS. 1–3 is essentially identical to the above-described device 22, and like parts and features of the two coating devices are designated by the same reference numerals in the drawings, except that the reference numerals used to designate the parts and features of device 22' are marked with a prime (').  Thus, in device 22' the head is designated 30', its slit is designated 36', the extended surface downstream of the slit (and facing the surface 20 of a strip advancing in path portion 18) is designated 32*a'*, the supporting deck is designated 48', etc.

Each of these two coating devices 22 and 22' is individually similar to the single coating device of the apparatus described in the aforementioned U.S. Pat. No. 4,675,230. In the structure shown in that patent, however, the strip article advancing past the coating head is supported (for example, by an axially fixed back-up roll) at a fixed distance from the head-supporting means. The present invention, in contrast, provides two opposed coating heads, in register with each other, between which the strip article passes.

More particularly, the coating devices 22 and 22' are disposed in facing, mirror-image relation to each other, on opposite sides of the rectilinear strip path portion 18, so as to deposit layers of coating material on the opposed major surfaces 19 and 20, respectively, of the strip. The axes 58 and 58', about which the decks 48 and 48' of the two coating devices respectively rotate, are parallel to each other and to the surfaces of a strip advancing in path portion 18 (from which they are typically equidistantly spaced), and lie in a common plane perpendicular to the plane of path portion 18.

In this apparatus arrangement, then, there are provided two rigid coating heads 30, 30', each defining an elongated open-sided slit (36, 36') and having an extended surface (32*a*, 32*a'*) immediately adjacent the open side of the slit, for respectively depositing layers of liquid coating material on the opposed major surfaces 19, 20 of a strip article 10 advancing in the path; and means (i.e. feed passages 40 and 40', FIG. 4) for supplying liquid coating material under pressure to the slit of each head. Further, in the embodiments of FIGS. 1–6, each of the heads 30 and 30' is a unitary, integral element, wherein the land portion is simply that portion of the integral head having the extended surface 32*a* or 32*a'* formed thereon.

The decks 48, 48' support the two heads 30, 30' in facing relation to each other on opposite sides of the rectilinear portion 18 of the strip article path while permitting individual translational movement of the two heads relative to the decks in directions perpendicular to the long dimensions of their respective slits. The heads are so positioned that their slits respectively open toward the opposed major surfaces 19 and 20 of an advancing strip article in the rectilinear path portion 18 with the long dimensions of the slits extending transversely of the path, and with the extended surfaces 32*a* and 32*a'* of the two heads disposed, substantially in register with each other, beyond the slits in the direction of strip article advance. These extended surfaces respectively face the opposed major strip surfaces 19 and 20 and converge toward each other and toward the strip surfaces in the direction of article advance, the angles of convergence of the extended surfaces 32*a* and 32*a'* being individually adjustable by means of the screws 62 and 62', respectively. During operation, with the strip article advancing past the slits 36 and 36' and liquid coating material supplied to both slits, the article major surfaces respectively drag layers of coating material from the slits, the layers being thereby deposited on the article major surfaces.

The air cylinders 64 and 64' with their associated piston shafts 68 and 68' respectively constitute means, acting between heads 30 and 30' and their supporting decks 48 and 48', for continuously exerting a load on each head to urge the heads respectively toward the opposed major surfaces of a strip article advancing in the path portion 18, such that, during operation as aforesaid, the heads are respectively urged by the load-exerting means against the layers of coating material deposited on the strip major surfaces to maintain the deposited coating layers at predetermined constant thicknesses while the coating layers alone hold the heads entirely away from contact with the strip article major surfaces. The load-exerting means (64, 68 and 64', 68') for the two heads are adjustable to individually vary the loads exerted on the two heads.

It will be appreciated, therefore, that in these embodiments the load-exerting means act between the supporting structure and each of the two heads, and exert loads on the land portions of both heads by exerting such loads on each head as a unit.

Figure 5:
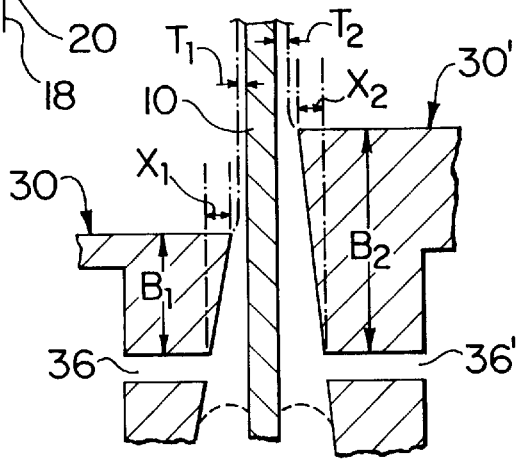
FIG. 5 is a fragmentary view similar to FIG. 4 illustrating certain positional and dimensional relationships of the two heads.

In the embodiment of FIGS. 1–3, the extended surfaces 32*a* and 32*a'* of the two heads are shown as equal to each other in length. However, as illustrated in FIGS. 4 and 5, the extended surface of one of the heads may be longer than that of the other in the direction of advance of the strip article in the path.

The practice of the method of the invention with the apparatus described above may now be readily explained. For continuously and simultaneously applying layers of liquid coating material to both opposed major surfaces 19 and 20 of an elongated flexible strip article 10, the strip article is continuously longitudinally advanced along the path 12 and along the rectilinear path portion 18, while liquid coating material is supplied under pressure to the slits 36, 36' of the heads 30, 30', and while a load is continuously exerted on both heads (by cylinders 64 and 64', respectively) to urge the heads respectively toward the opposed major surfaces of the advancing strip. As the strip advances, its surfaces 19 and 20 respectively drag layers of coating material from the slits 36 and 36', the layers being thereby deposited on the strip surfaces; and the loads exerted by the cylinders 64 and 64' press the heads against the layers of coating material deposited on the strip surfaces, so as to maintain those coating layers at predetermined constant thicknesses while the coating layers alone hold the heads entirely away from contact with the article major surfaces.

More particularly, at the outset of operation, the loads exerted on the two heads by cylinders 64 and 64' initially bring the edges 44 and 44' of the heads against the strip surfaces 19 and 20, respectively. As advance of the strip commences, and paint is supplied under elevated pressure to the manifolds and thence to the slits 36, 36', the fluid pressure of paint forced into the spaces between the strip surfaces and the head surfaces 32*a*, 32*a'*, in the direction of strip advance, causes the heads to back off from contact with the strip surfaces. Thereby, a metering orifice is defined between each head edge 44 or 44' and the facing strip surface 19 or 20, the size (aperture) of this orifice being determined (for paint of a given viscosity) by the magnitude of the loads exerted by the cylinders.

The rates of paint flow through the slits, and the fluid pressure of paint acting on the strip surfaces in the gaps beyond the slits are primarily determined by drag forces of the strip rather than by the supply pressure of paint in the manifold. Thus, a small positive paint supply pressure (e.g. 5 p.s.i.) is typically sufficient, and the aforementioned drag forces, as the strip surface moves past the slot opening, create much higher fluid pressures between the strip surfaces and the facing head surfaces.

As advance of the strip 10 continues, with continuing supply of paint under pressure to the slits, uniform layers of paint are deposited on the opposed strip surfaces. Throughout the operation, the cylinders continuously maintain loads on the heads, urging the heads toward the strip surfaces being coated, and these loads serve to maintain the apertures of the aforementioned metering orifices constant, regardless of local variations in strip thickness. In effect, each head surface 32*a* or 32*a'* floats on the layer of paint being applied by that head, and is maintained (by that layer alone) entirely away from contact with the facing strip surface while coating proceeds. The invariant aperture of each metering orifice, resulting from the described load on each head, produces paint coatings of uniform thickness.

As will be appreciated, in the described coating operation, force is generated when the gap between a strip surface 19 or 20 and the facing head surface 32*a* or 32*a'* converges. The force generated depends on paint viscosity, strip speed, width of the surface 32*a* or 32*a'* downstream of the slit, and, to a lesser extent, on the angle of convergence, in a manner consistent with principles of lubrication theory. The load to be exerted on each head by its associated cylinders 64 or 64' in any particular operation is determined by the viscosity of the paint being applied and the desired thickness of the coating; thus, at the outset of a given coating operation, the cylinders are adjusted to provide the particular loads required for that specific operation.

For optimum performance, the configuration and dimensions of the head surfaces 32*a* and 32*a'* are also selected with reference to the factors of viscosity and desired coating thickness. Stated in general, application of a relatively thin film or layer of a high viscosity coating is best performed with a head in which the dimension of surface 32*a* or 32*a'* between the slit and edge 44 or 44' is short, while for application of relatively thick films of low viscosity coatings, a relatively long surface 32*a* or 32*a'* is preferred. It is important that each head provide an extended surface (as distinguished from a sharp edge) on the outlet or downstream side of the slit, in order to achieve the above-described floating action, i.e. in order that the head, under load, will ride on the applied liquid coating layer and be held by that layer away from contact with the subjacent strip surface.

While the air cylinders illustrated in the drawings and described above represent a currently preferred means for exerting continuous (yet adjustable or selectable) load on the heads, other arrangements may also be employed. For example, the loads could be exerted by springs acting under compression between the rear surfaces of the heads and structure fixed to the supporting decks, such springs being arranged in known manner to enable variation in their degree of compression for adjusting the magnitude of the exerted loads.

Stated more generally, the purpose of the load-exerting means is to exert, on the applied liquid coating layer between each coating head and the facing strip surface, a load which is maintained essentially constant across the full width of the strip and throughout the duration of a given coating operation, thereby to achieve the desired constant and uniform aperture of the metering orifice. In many instances, this objective is adequately achieved by simply operating the air cylinders (in the illustrated embodiments of the invention) to exert constant loads of preselected magnitude on the heads, balanced between the ends of the slits, for the duration of a given coating operation. In other cases, it may be preferable (for example) to vary the supplied loads along the lengths of the slits, viz. to exert loads which (at any given point in time) may be nonuniform over the slit long dimensions, fluctuating in accordance with nonuniformities in the advancing strip across the width of the strip, thereby to maintain constant loads on the applied paint layers across the strip width by compensating for these nonuniformities; and the coating head itself may be made somewhat flexible (in the direction transverse to the strip) to facilitate compensation for such nonuniformities, all within the broad contemplation of the invention.

Satisfactory operation of the described apparatus requires that the clearances between the extended surfaces (32*a* and 32*a'*) of both coating heads and the strip converge in the direction of sheet travel, to generate a hydrodynamic pressure, between the extended surface of each head and the strip, that will increase as the strip gets closer to the head surface. Provided that the angles of convergence are chosen correctly, there will be an equilibrium position for the strip where the pressure forces on both sides will be equal.

The position of equilibrium and hence the coating film thickness distribution on the two sides of the strip can be controlled in two ways, viz. by varying either the angle of convergence or the lengths (in the direction of strip advance) of the extended surfaces of the heads. Within limits, increasing the angle of convergence will increase the hydrodynamic pressures generated. Therefore, increasing the angle for one of the two heads will cause the position of strip equilibrium to shift away from that head and the coating film thickness on that side of the strip will increase. Similarly, increasing the length of the extended surface of one of the heads will cause the film thickness to increase on that side of the strip.

In FIGS. 4 and 5, the heads 30 and 30' are shown as having extended surfaces of differing lengths and angles of convergence. The length of the extended surface 32*a* of head 30, in these figures, is $B_1$, while that of extended surface 32*a'* of head 30' is $B_2$, it being noted that these dimensions are measured in a direction parallel to the direction of advance of the strip 10 past the heads. The angle of convergence of surface 32*a* of head 30 equals arctan $X_1/B_1$, and the angle of convergence of surface 32*a'* equals arctan $X_2/B_2$, where X is the spacing between the planes (parallel to the direction of strip advance) respectively containing the downstream edge of slit 36 or 36' and the downstream edge 44 or 44' of the head. The thickness of the paint layer deposited by head 30 is $T_1$, while the thickness of the layer deposited by head 30' is $T_2$. $P_1$ and $P_2$ are, respectively, the loads exerted by cylinders 64 and cylinders 64' on heads 30 and 30'. The regions occupied by delivered paint, in the gaps between the heads and the strip, are approximately indicated by the broken lines in FIG. 5.

Assuming that the two opposed strip surfaces were being coated with paint of the same viscosity, and that $P_1=P_2$, $T_2$ would equal $T_1$ if $B_2=B_1$ and arctan $X_2/B_2$=arctan $X_1/B_1$. As represented in FIG. 5, however, $B_2>B_1$ (though $X_2$ is sufficiently larger than $X_1$ so that arctan $X_2/B_2$=arctan $X_1/B_1$); hence, in this example, $T_2>T_1$.

In the embodiments thus far described, both of the coating heads are translatable (relative to the supporting structure) in directions perpendicular to the major surfaces of the advancing strip article which is to be coated; and load-exerting means, i.e., air cylinders 64, 64', are provided for continuously exerting a load on each of the two heads to urge the heads respectively toward the opposed major surfaces of the strip. The invention also embraces embodiments in which a load is exerted on only one of the heads (or only on the land portion of one of the heads, as hereinafter further explained), the other head being held fixed or stationary by the supporting structure during a coating operation. Embodiments thus having a load exerted on only one head or its land portion, the other head being stationary during operation, are currently preferred for applications wherein the strip to be coated (e.g., aluminum alloy can lid stock sheet) is very thin and flexible. The principles of operation of these embodiments, and the advantages achieved, are essentially the same as for the embodiments described above with reference to FIGS. 1–6.

Figure 8:
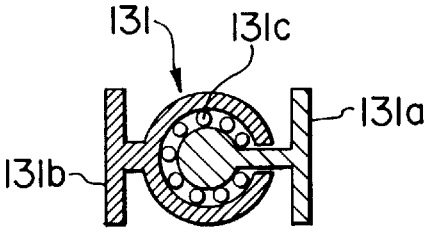
FIG. 8 is a sectional view taken as along the line 8—8 of FIG. 7.
Figure 7:
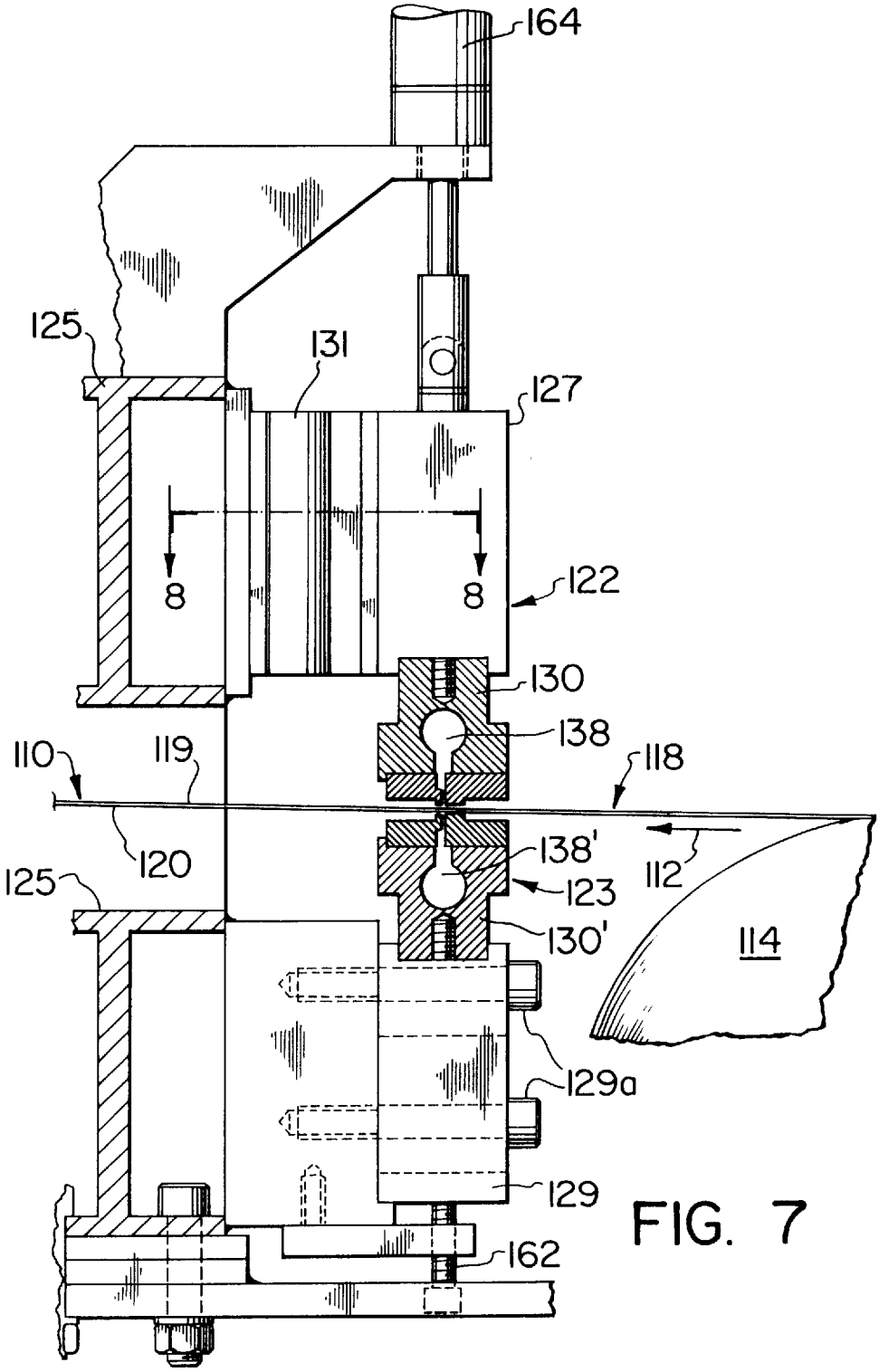
FIG. 7 is a simplified elevational view, partly in section, of another embodiment of the apparatus of the invention.
Figure 9:
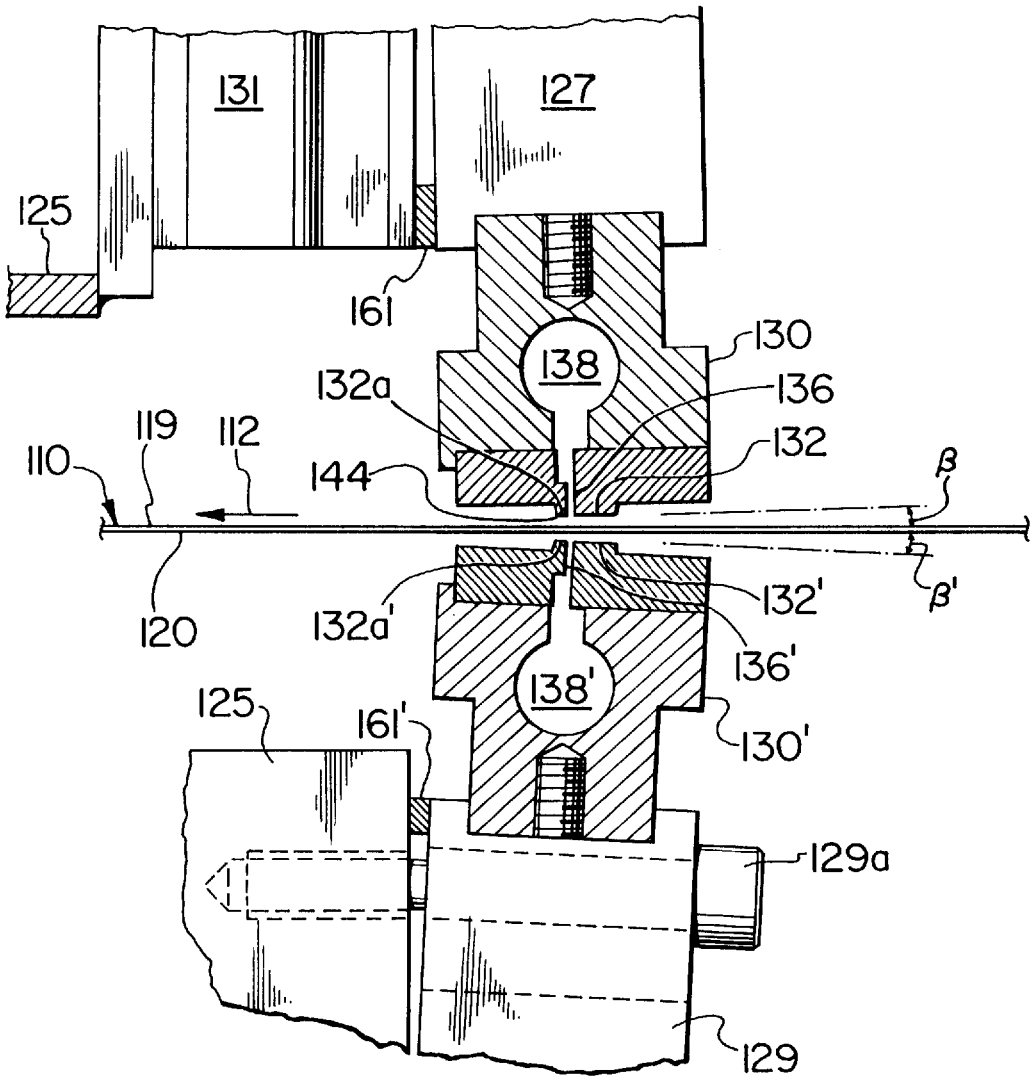
FIG. 9 is an enlarged fragmentary elevational view, again partly in section, of the apparatus of FIG. 7.

One such embodiment is illustrated in FIGS. 7–9, arranged for application of a lacquer coating to both of the opposed major surfaces of a thin strip 110 of aluminum alloy can lid stock, prior to forming the stock into lids, as the strip is continuously advanced lengthwise in the direction indicated by arrow 112 along a path defined by means including a guide roller 114. The strip path thus defined includes a rectilinear portion 118 in which the major surfaces of the advancing strip are substantially planar. The rectilinear path portion 118 in FIG. 7 extends horizontally rather than vertically, but in all other pertinent respects the path of the strip through the coating line may be essentially as described with reference to FIG. 1 above.

At a locality in path portion 118, lacquer is applied to both major surfaces 119, 120 of the strip from two coating devices 122, 123 disposed in register with each other, respectively above and below the path of the strip and respectively facing the two major surfaces of the strip. These two coating devices are both supported by a rigid frame structure 125 which may be fixed relative to the strip path defined by roller 114 and associated elements (not shown). The upper coating device 122 (above the strip) includes a transverse support bar 127 carrying an upper coating head 130 and mounted for substantially vertical movement relative to frame 125 by means of a linear ball bearing assembly 131 (FIG. 8), which comprises a rod 131*a* and a sleeve 131*b* respectively secured to the frame 125 and bar 127, with ball bearings 131*c* contained between them. The lower coating device 123 (below the strip) also includes a transverse support bar 129 carrying the lower coating head 130' and secured to the frame 125 by bolts 129*a*.

Means comprising a plurality of air cylinders 164 (one being shown in FIG. 7) are mounted on the frame 125 above the upper coating device 122 for exerting a downwardly directed load on the upper coating head 130 (i.e., in a direction substantially perpendicular to the major surfaces of the strip advancing in path portion 118) through the vertically movable upper transverse support bar 127. The air cylinders act on the bar 127, and thus on head 130, at locations spaced along the length of the head and bar (transverse to the plane of the view of FIGS. 7 and 9). No load-exerting means is provided for the lower coating head 130', which is held fixed in position during a coating operation by the bar 129 and a subjacent set screw 162. Consequently, the load-exerting means exerts a load only on the upper head in this embodiment, the lower head being stationary.

Although the heads 130 and 130' differ to some extent in shape and structure from the heads 30 and 30' of FIGS. 1–6, they are essentially the same as the latter heads in all functional respects. Thus, head 130 is formed with a flat surface 132 facing and spaced from the surface 119 of the advancing strip article to define therewith a gap, and extending over the entire width of the strip. An elongated rectilinear slit 136 (of uniform cross section from end to end) opens outwardly through surface 132 toward the strip surface 119; this slit extends across the width of the strip, and may have its ends closed by means such as dams or shutters (not shown) to define an effective aperture equal to or less than the width of the strip. At its inner end, slit 136 communicates along its entire length with an enclosed manifold chamber 138 formed in the head for containing a quantity of liquid coating material (e.g. lacquer) under pressure. During a coating operation, the coating material is continuously delivered to the manifold under pressure from a suitable source through suitable conduit or other means (also not shown), and passes from the manifold through the slit for deposit as a continuous coating layer on the advancing strip surface 119 across the full width of the effective aperture of the slit.

The surface 132 includes a portion 132*a* extending from the slit 136 downstream to a sharp discontinuity or edge 144 (spaced from and parallel to the slit) at which the head surface is offset away from the path of strip 110 to form a 90° corner, ensuring against undesired pick-up of coating material from the strip surface onto the head surface downstream of edge 144. This 90° edge 144, extending across the full width of the strip at the downstream extremity of the surface portion 132*a*, cooperates with the strip surface 119 to define a metering orifice that determines the thickness of the coating layer carried away from the head 130 on the strip surface.

Head 130' is essentially identical in structure and function to head 130; thus, as shown, it includes a planar surface 132' extending across the full width of strip surface 120 in facing spaced relation thereto, a slit 136' opening through surface 132' toward strip surface 120 and likewise extending across the strip width, and a manifold chamber 138' formed in head 130' (and communicating with slit 132' along the full length thereof) for receiving liquid coating material under pressure from a supply source through suitable means (not shown). The ends of the slit 132', like those of slit 132, may be closed by dams, shutters or the like (not shown) to define a desired effective aperture for the slit; the liquid coating material passes from the manifold through the slit to the advancing strip surface 120 for deposit as a continuous coating layer thereon. A portion 132*a'* of surface 132' extends from slit 136' to a sharp edge (similar to edge 144 of head 130) spaced downstream from the slit and extending transversely of the strip, the surface of head 130' being offset to form the latter edge as a 90° corner at the downstream extremity of surface 132*a'*. This edge cooperates with strip surface 120 to define a metering orifice that determines the thickness of the coating layer carried on the latter strip surface away from the head 130'.

The two coating heads 130 and 130' (like the above-described heads 30 and 30' of FIGS. 1–6) are disposed in facing mirror-image relation to each other across the path of strip advance, with their respective slits 136 and 136' in register, and with their respective downstream surface portions 132*a* and 132*a'* likewise in register, for simultaneously applying layers of coating material to the opposite major surfaces 119 and 120 of an advancing strip article 110. In this arrangement, the surface portions 132*a* and 132*a* respectively constitute the extended surfaces (corresponding to the surfaces 32*a* and 32*a'* of heads 30 and 30') immediately adjacent the open sides of the slits. Again as in FIGS. 1–6, the portions of the heads bearing these surfaces (i.e., the land portions of the heads) are integral with or at least fixed in relation to the other portions of the heads.

Also as in FIGS. 1–6, the surfaces 132*a* and 132*a'* converge in the direction of strip advance, so that the gap defined between each of these surfaces and the facing surface of the strip 110 is progressively reduced in vertical extent from the slit to the metering orifice defined between the strip surface and the 90° edge (144, in the case of head 130) at the downstream extremity of surface 132 or 132*a*. Means are provided for individually setting and varying the angles of convergence β and β' of the two surfaces 132*a* and 132*a'*, such means being shown in FIG. 9 as shims 161 and 161' respectively inserted between the transverse support bars 127, 129 and their mountings. The shim 161 is inserted between the lower portion of the upper transverse support bar 127 and the ball bearing assembly 131, while the shim 161' is inserted between the upper portion of the lower transverse support bar 129 and the frame 125, the bolts or other means for connecting the transverse support bars to the mounting structure being so arranged as to secure the transverse support bars fixedly at any of a range of angles determined by the thicknesses of the inserted shims. The angle of convergence of either surface 132*a* or 132*a'* can be altered by replacing the associated shim 161 or 161' with another of greater or lesser thickness.

The performance of the method of the invention using the apparatus of FIGS. 7–9 is essentially the same as that described above for the embodiment of FIGS. 1–6, except that a load is exerted from only one side, viz., only on the upper head 130, which is vertically movable relative to the frame 125 by virtue of ball bearing assembly 131, while the lower head 130' is maintained fixed or stationary relative to frame 125. In operation with the strip 110 advancing past the coating head slits 136, 136' and liquid coating material supplied to both slits through the respective manifolds 138, 138', the strip major surfaces respectively drag layers of coating material from the slits, the layers being thereby deposited on the strip surfaces 119 and 120. The load, exerted by cylinders 164 on head 130 continuously during the coating operation, causes the layers of coating material respectively deposited on the strip surfaces 119 and 120 to be pressed between the extended surfaces 132*a* and 132*a'* of the heads and to be maintained at predetermined constant thicknesses while the coating layers alone hold the heads entirely away from contact with the strip surfaces.

The apparatus of FIGS. 7–9 tends to be self-centering in operation, in that the greater the force that is applied by the air cylinders 164 to the upper head 130, the more counter-acting force pushes up on the lower surface of the strip. As in the case of the embodiments of FIGS. 1–6, the thicknesses of the coating layers respectively applied to the two opposed major surfaces of the strip can be selected, and made equal or unequal, by appropriate selection of the angles of convergence and/or land widths of surfaces 132*a* and 132*a'* (the land width being, as before, the distance between the downstream edge of the slit 136 or 136' and the metering edge at the downstream extremity of surface 132*a* or 132*a'*, measured in the direction of strip advance). For example, in coating aluminum alloy can lid stock for beer can lids, the angles of convergence and/or land widths are typically selected (in the manner described above with reference to FIGS. 1–6) to provide lacquer coatings of equal thicknesses on both surfaces, whereas in coating such lid stock for soft drink can lids, the convergent angles and/or land widths are so adjusted that the lacquer coating on the surface that ultimately faces the can interior is three times as thick as that on the can exterior, since soft drinks tend to be more corrosive than beer.

The reason for employing apparatus having a stationary lower coating head (with the load exerted only on the upper coating head) for coating can lid stock is that, with such highly thin and flexible strip, it would not be possible to meet the critical requirement of maintaining constant entry angles if both heads were movable. Air cylinders acting on both heads would tend to position the strip slightly up or down from its central course of travel. Additionally, it is desirable to locate the coating heads as close as possible to a guide roller over which the strip is trained, so as to minimize strip flexing, which can also contribute to entry angle variation.

For other uses, such as the application of forming lubricant coatings on opposed surfaces of automobile body sheet (aluminum alloy stock to be formed into automobile body panels), which is substantially stiffer than can lid stock and is usually held under higher tension, it may be preferred to mount both heads for movement and to exert loads on both (as in the embodiments of FIGS. 1–6). The apparatus of FIGS. 7–9 can be adapted to such use by mounting both transverse support bars 127 and 129 on ball bearing assemblies 131 and providing air cylinders to act on the lower as well as the upper head in the manner described above with reference to FIGS. 1–6.

Figure 10:
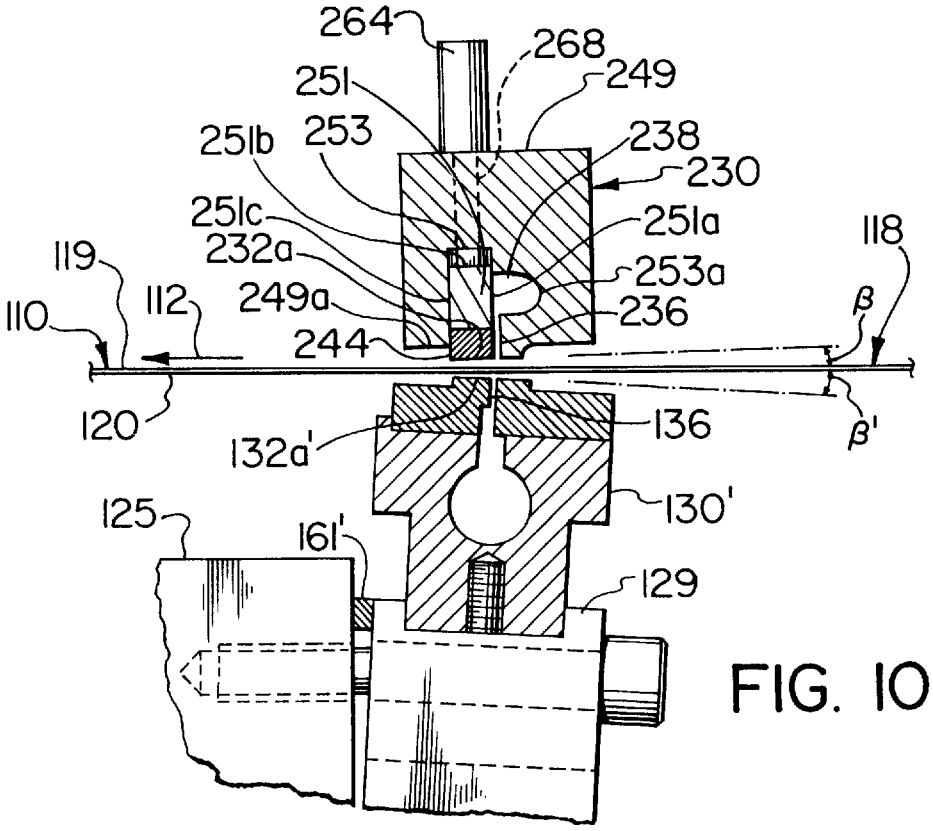
FIG. 10 is a simplified fragmentary elevational view, partly in section, of a further embodiment of the apparatus of the invention.
Figure 11:
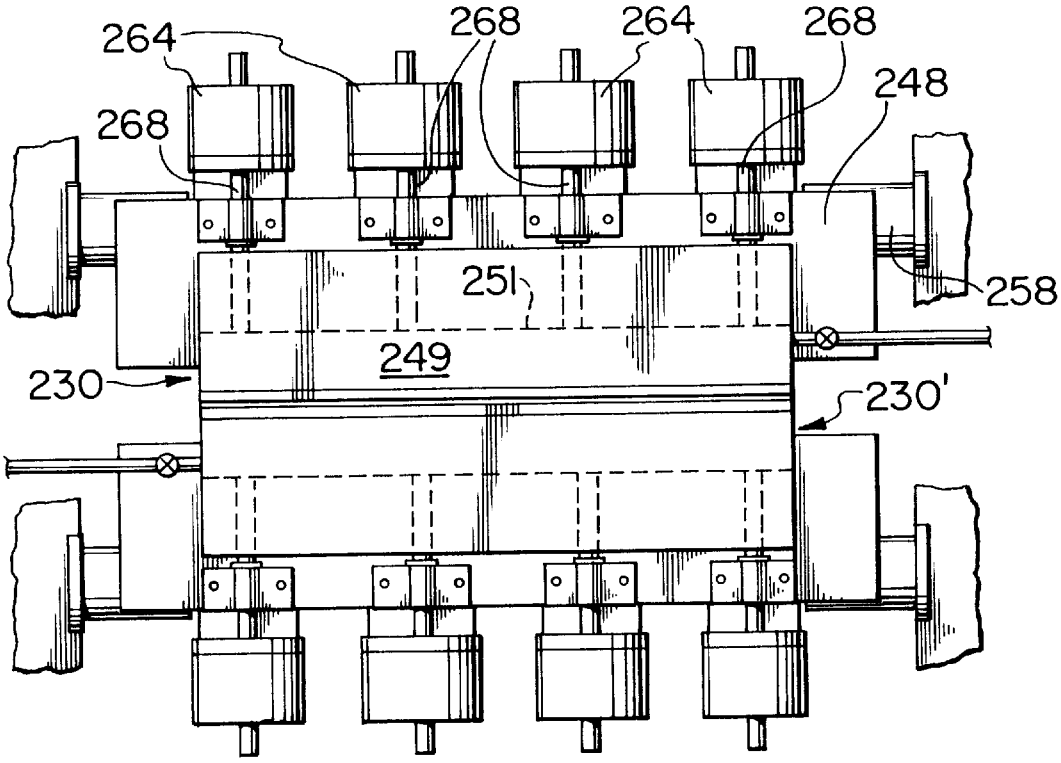
FIG. 11 is an elevational view, taken as along the line 11—11 of FIG. 10, of yet another embodiment of the invention.

Another, and currently preferred, embodiment of the apparatus of the invention is shown in FIG. 10, reference also being made to FIG. 11 for a complete understanding of the structure of this embodiment. This embodiment corresponds in structure, arrangement and function to that of FIGS. 7–9 except that the upper coating head 130 of the latter embodiment is replaced by a coating head 230 comprising a fixed portion 249 and a land portion 251 movable translationally, within the fixed portion, toward and away from the upper major surface 119 of a strip 110 (to be coated) which is advancing horizontally in direction 112 in a rectilinear portion 118 of its path of advance.

The land portion 251 is a solid member of rectangular cross section extending horizontally across the full width of the path of strip 110, and received in a cavity or recess 253 in the fixed head portion 249 for guided sliding movement (relative to portion 249), perpendicular to its long axis, toward and away from the strip surface 119. The bottom surface 232*a* of this portion 251 is a planar land, corresponding positionally and functionally to the extended surfaces or lands 32*a* of FIGS. 1–6 and 132*a* of FIGS. 7–9, and facing the strip surface 119. The long side surface 251*a* of portion 251 (on the upstream side of portion 251, with reference to direction 112) cooperates with an enlarged region 253*a* of the recess 253 in the fixed head portion 249 to define a manifold chamber 238 for receiving liquid coating material under pressure, and a slit 236 through which the liquid coating material passes from the manifold for deposit on the surface 119 of the advancing strip. The slit 236 extends across the width of the strip path and opens toward the strip surface 119 immediately upstream of the extended land surface 232*a,* which cooperates with strip surface 119 to define a gap immediately downstream of the slit.

As best seen in FIG. 11, which also shows the head 230 (in side elevational view), a downwardly directed load is exerted on land portion 251 by a plurality of air cylinders 264 spaced evenly along the length of the portion 251, i.e., transversely of the strip path. If desired, a proximity sensor (not shown) can be provided for land portion 251, in the manner described in the aforementioned U.S. Pat. No. 5,147,462, for the control purposes therein set forth. The vertical dimension of land portion 251 (viz., the distance between bottom surface 232*a* and the opposite, upwardly facing surface 251*b* of portion 251) is substantially smaller than that of the corresponding unitary head 130 of FIGS. 7–9, being typically about 1½ inches, so that the land portion can flex in the direction transverse to the moving strip, the land portion being made of a material (e.g., metal) capable of such flexing when formed into a bar of the indicated dimensions. The degree of transverse flexing thus provided is selected to be sufficient to accommodate strip thickness variations across the width of the strip, thereby to maintain a constant coating layer thickness across the strip width despite such variations. To facilitate the flexing of the land portion 251, as shown, air cylinders 264 are provided not only adjacent its opposite ends (as in FIG. 3) but also at regular intervals along its length between its ends. The pistons 268 of the air cylinders extend through bores in the fixed head portion 249 and act against the land portion 251 (urging it downwardly) at locations preferably spaced not more than about seven inches apart; thus, for a land portion 251 about 30 inches long, preferably four air cylinders are provided as shown in FIG. 11.

At its downstream extremity (in direction 112), the extended land surface 232*a* of land portion 251 terminates in a sharp (90°) edge 244, i.e., a longitudinal corner between surface 232*a* and the downstream long side surface 251*c* of land portion 251 (which surfaces are normal to each other). This edge 244, extending perpendicular to and horizontally across the full width of the strip path, corresponds positionally and functionally to edge 144 of head 130 in FIGS. 7–9, cooperating with strip surface 119 to define a metering orifice at the outlet end of the gap defined between surfaces 119 and 232*a* for determining the thickness of the applied coating layer. In use, the land portion 251 projects (as shown) downwardly beyond the bottom surface 249*a* of the fixed head portion 249 on the downstream side of slit 236 so that the edge 244 and an adjacent lower portion of side surface 251*c* are exposed, and there is no pick-up of coating material on the head beyond edge 244. Upstream of the slit, the bottom surface of the fixed head portion may be essentially identical in shape to that of the corresponding region of the head surface 132 in FIGS. 7–9.

Surface 232*a* converges toward the path of strip advance, in the direction 112, at an angle β. To establish, and enable change of, this angle of convergence, the fixed head portion 249 may be bolted or otherwise secured to a portion of the frame 125 in a manner accommodating insertion of angle-determining shims (not shown), generally as illustrated and described above with reference to the mounting of the two heads of FIGS. 7–9. Alternatively, and as illustrated in FIG. 11, the head 230 with its associated air cylinders may be supported on a member 248 (similar to deck 48 of FIGS. 2 and 3) for pivotal movement about an axle 258, with which a set screw arrangement (similar to set screw 62, FIG. 3, but not shown) is employed to determine the angular orientation of the head, including surface 232*a,* relative to direction 112.

The lower head 130' in FIG. 10, disposed with its slit 136' in register with the upper head slit 236, is essentially identical to the like-numbered lower head 130' in FIGS. 7–9, although its extended surface 132*a'* downstream of the slit 136' (as also the surface 232*a* of the upper head) is shown as having a greater land width (dimension measured in direction 112) than the corresponding surface in the apparatus of FIGS. 7–9. Head 130' in FIG. 10 is mounted in the same manner as in FIGS. 7–9 on the transverse support bar 129 secured to frame 125, and the angle β' of convergence of its surface portion 132*a'* toward the strip path is determined by the width of a shim 161' inserted between bar 127 and frame 125.

The performance of the method of the invention with the apparatus of FIG. 10 is essentially the same as with the apparatus of FIGS. 7–9, except that only the land portion 251 of head 230 is subjected to load (and is movable) during application of coating, and this land portion undergoes flexing transversely of the strip width to accommodate transverse variations in strip thickness for enhanced uniformity of coating thickness.

The FIG. 10 apparatus, having a single movable land surface (the lower head surface 132*a'* being held stationary during coating), is suitable for the coating of very thin and flexible strip such as can lid stock. To coat stiffer stock, it may be preferred to apply a load to both the upper and lower extended (land) surfaces, with both being movable toward and away from the strip path. Apparatus of this character, incorporating upper and lower coating heads both having fixed portions and movable land portions (with attendant reduction in dimension of the movable portion on which force is exerted, to accommodate transverse variations in strip thickness), is shown in FIG. 11. The path of the strip past the coating heads is again rectilinear and horizontal, as in FIGS. 7–10. The upper coating head 230, with its air cylinders, mounting and associated elements is the same as the like-numbered head 230 in FIG. 10. The lower coating head 230' is essentially identical to head 230, in mirror-image inverted arrangement, and is disposed in register therewith.

Figure 12:
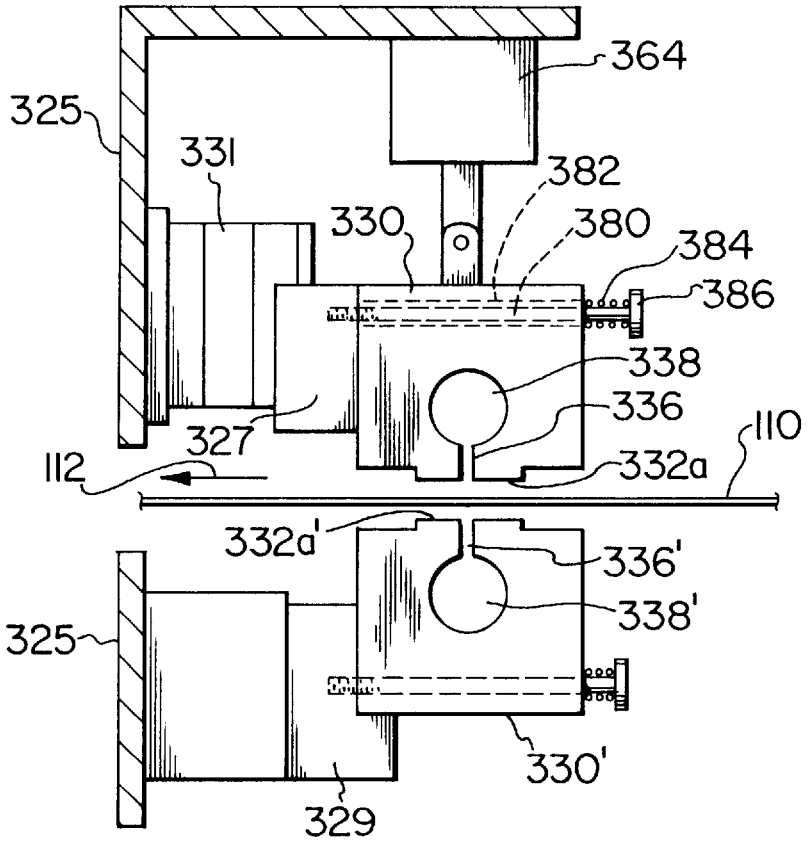
FIG. 12 is a simplified schematic view, similar to FIG. 7, of a still further embodiment of the invention.

FIG. 12 illustrates a further embodiment of the apparatus of the invention, again including a vertically movable upper coating head 330 and a stationary lower coating head 330' for respectively applying coating material to the upper and lower surfaces of a strip 110 advancing horizontally between the heads in the direction 112. Except as hereinafter described, the apparatus of FIG. 12 may be essentially the same, in structure and function, as that of FIGS. 7–9. The coating heads of FIG. 12 are unitary, integral members, supported by rigid frame structure 325 fixed relative to the strip path, and respectively have slits 336 and 336', manifold chambers 338 and 338', and flat surface portions 332*a* and 332*a'* extending downstream of the slits 336 and 336', all corresponding to the like features of the heads of FIGS. 7–9. The upper head 330 is carried by a transverse support bar 327 mounted for substantially vertical movement relative to frame 325 by means of a linear ball bearing assembly 331 of the type illustrated in FIG. 8, while the lower head is fixedly bolted to a transverse support bar 329 mounted on a lower portion of the frame 325. A plurality of air cylinders 364 are mounted on the frame 325 above the upper head 330 for exerting a downwardly directed load on the head 330.

The FIG. 12 apparatus differs from that of FIGS. 7–9 in that the upper head 330, including its surface portion 332*a*, undergoes vertically directed flexing transversely of the strip width (i.e., like the separately movable land portion 251 of FIG. 10) to accommodate transverse variations in strip thickness for enhanced uniformity of coating thickness. More particularly, the unitary head 330 of FIG. 12 is dimensioned to be capable of the described transverse flexing. The plural air cylinders 364, spaced along the length of head 330 (transversely of the strip path, in the same manner as cylinders 264 of FIG. 11), act directly downwardly on the head rather than (as in FIGS. 7–9) on an interposed rigid transverse support bar, which would prevent flexing of the head. The support bar 327 of FIG. 12 extends along the side of the head 330 and is secured thereto by means of bolts 380 extending horizontally through slots 382 formed in the upper portion of the head body, springs 384 being interposed under compression between the head 330 and nuts 386 threaded on the bolts. Thus, the support bar does not constrain the head against vertical flexing from point to point along its length.

The flexing of the head 330 in FIG. 12 serves the same purpose as the flexing of the land portion 251 in FIG. 10. In this respect the FIG. 12 apparatus constitutes an alternative to that of FIG. 10, where only the land portion 251 of the head 230 undergoes such transverse flexing, for the same purpose. That is to say, the head 330 of FIG. 12 differs from the head 230 of FIG. 10 in having no separately movable land portion such as is shown at 251 in FIG. 10; instead, the entire head 330 flexes, surface portion 332*a* being formed instead on the downwardly facing surface of the unitary body of the head 330.

It is to be understood that the invention is not limited to the features and embodiments herein specifically set forth, but may be carried out in other ways without departure from its spirit.

What is claimed is:

1. Apparatus for continuous two-sided coating of an elongated strip article, comprising:

(a) means for defining a path and direction of continuous longitudinal advance of an elongated strip article having opposed major surfaces to be coated, said path including a rectilinear portion in which said opposed surfaces are substantially planar;

(b) two coating heads each defining an elongated open-sided slit and each including a land portion having an extended surface immediately adjacent the open side of the slit, for respectively depositing layers of liquid coating material on the opposed major surfaces of a strip article advancing in said path;

(c) means for supplying liquid coating material under pressure to the slit of each of said heads;

(d) means for supporting the two heads in facing relation to each other on opposite sides of said rectilinear portion of said path while permitting individual translational movement of at least the land portion of at least one of said heads relative to said supporting means in a direction perpendicular to the major surfaces of a strip article advancing in said path, said supporting means positioning said heads such that their slits respectively open toward the opposed major surfaces of a strip article advancing in said path portion with the slits extending transversely of the path, such that said extended surfaces of the two heads are disposed, substantially in register with each other, beyond the slits in the direction of strip article advance, with said extended surfaces facing respectively the opposed major surfaces of a strip article advancing in said path and converging toward each other and toward the path in the direction of strip article advance, and such that during operation with the article advancing past the slits and liquid coating material supplied to both slits as aforesaid, the article major surfaces respectively drag layers of coating material from the slits, the layers being thereby deposited on the article major surfaces; and (e) means for continuously exerting a load on at least said land portion of said one head during operation as aforesaid such that the layers of coating material deposited on said article major surfaces are pressed between said extended surfaces to maintain said layers at predetermined constant thicknesses while said layers alone hold the heads entirely away from contact with the article major surfaces.

2. Apparatus as defined in claim 1, wherein the land portion of the other of said heads is stationary in position relative to the supporting means during operation as aforesaid.

3. Apparatus as defined in claim 1, wherein said supporting means permits individual translational movement of at least the land portions of both of said heads relative to said supporting means in directions perpendicular to the major surfaces of a strip article advancing in said path, and wherein said load-exerting means comprises means for continuously exerting a load on at least the land portion of each head to urge the extended surfaces of the heads respectively toward the opposed major surfaces of an article advancing in the path portion, such that, during operation as aforesaid, the extended surfaces of the heads are respectively pressed by the load-exerting means against the layers of coating material deposited on said article major surfaces to maintain said layers at predetermined constant thicknesses while said layers alone hold the heads entirely away from contact with the article major surfaces.

4. Apparatus as defined in claim 1, wherein at least said one head comprises said land portion and a stationary portion, said land portion being movable relative to said stationary portion, said stationary portion and said land portion cooperatively defining the slit of said one head, and wherein said load-exerting means comprises means acting between the land portion of said one head and said supporting means for continuously exerting a load on said land portion of said one head to urge the extended surface of said land portion of said one head toward an article advancing in the path portion.

5. Apparatus as defined in claim 1, wherein said one head is formed integrally and is movable as a unit, relative to said supporting means, in a direction perpendicular to the major surfaces of a strip article advancing in said path; and wherein said load-exerting means comprises means for continuously exerting a load on said one head to urge the extended surface of said one head toward an article advancing in the path portion.

6. Apparatus as defined in claim 1, wherein each of said heads is formed integrally and is movable as a unit, relative to said supporting means, in a direction perpendicular to the major surfaces of a strip article advancing in said path; and wherein said load-exerting means comprises means, acting between each head and the head supporting means, for continuously exerting a load on each head to urge the heads respectively toward the opposed major surfaces of an article advancing in the path portion, such that, during operation as aforesaid, the heads are respectively pressed by the load-exerting means against the layers of coating material deposited on said article major surfaces to maintain said layers at predetermined constant thicknesses while said layers alone hold the heads entirely away from contact with the article major surfaces.

7. Apparatus as defined in claim 6, wherein said load-exerting means comprises means adjustable to individually vary the loads exerted on the two heads.

8. Apparatus as defined in claim 1, wherein said load-exerting means comprises at least one air cylinder acting on at least said one land portion.

9. Apparatus as defined in claim 4, wherein said land portion of said one head has a length extending transversely of the path and said strip has a width extending transversely of the path, wherein said load-exerting means comprises a plurality of air cylinders acting at points spaced along the length of said land portion of said one head, and wherein said last-mentioned land portion is sufficiently flexible to conform to variations of strip thickness across the width of the strip.

10. Apparatus as defined in claim 1, wherein each of the extended surfaces of said heads has an angular orientation relative to said rectilinear portion of said path and said supporting means includes means for individually varying the angular orientations of the respective extended surfaces of said heads in the direction of advance of the strip article.

11. Apparatus as defined in claim 1, wherein one of said extended surfaces is longer than the other in the direction of advance of the strip article in the path.

12. Apparatus as defined in claim 5, wherein said load-exerting means comprises a plurality of air cylinders acting at points spaced along the length of said one head, and wherein said one head is sufficiently flexible to conform to variations of strip thickness across the width of the strip.

13. Apparatus as defined in claim 1, wherein said path-defining means comprises means for defining a path and direction of continuous longitudinal advance of an elongated metal strip article.

* * * * *